US005371913A

United States Patent [19]

Smith

[11] Patent Number: 5,371,913

[45] Date of Patent: Dec. 13, 1994

[54] CAN CLEANING DEVICE

[76] Inventor: Joselito A. Smith, 5524 Sonata La., Dallas, Tex. 75241

[21] Appl. No.: 22,114

[22] Filed: Feb. 25, 1993

[51] Int. Cl.[5] ..... B08B 1/00

[52] U.S. Cl. ..... 15/104.94; 15/104.93; 15/211; 15/244.4

[58] Field of Search ..... 15/104.93, 104.94, 244.1, 15/244.4, 211

[56] References Cited

U.S. PATENT DOCUMENTS

| | | | |
|---|---|---|---|
| 1,582,367 | 4/1926 | Armstrong . | |
| 3,161,903 | 12/1964 | Worthington | 15/244.1 X |
| 4,628,563 | 12/1986 | Kramer | 15/236.05 X |
| 4,733,423 | 3/1988 | Blatt | 15/160 |
| 4,763,380 | 8/1988 | Sandvick | 15/160 |
| 4,802,927 | 2/1989 | Barbour | 15/244.4 X |
| 4,813,091 | 3/1989 | Glasener | 15/160 |
| 4,912,801 | 4/1990 | Hammill | 15/160 |
| 4,930,177 | 6/1990 | Rastutis | 15/236.05 X |
| 5,014,869 | 5/1991 | Hammond | 220/90.2 |
| 5,031,264 | 7/1991 | Muster | 15/104.93 |

*Primary Examiner*—Chris K. Moore
*Attorney, Agent, or Firm*—Locke Purnell Rain Harrell

[57] ABSTRACT

A disposable, one-piece, bristleless can cleaning device including a body, cyclindrical in cross-section with a circular base wall and integral annular, concentric outer and inner side walls, the outer wall formed along the periphery of the base wall and the inner wall being located inwardly from the outer wall, the two walls forming a cavity for receiving the upper end portion of a can. The can cleaning device is made of a sturdy, resilient, absorbent material that has been treated with a sanitizing substance. The side wall and the inner wall both extend downwardly frown the base of the device, the side wall extending downwardly over the outer upper portion of the can exterior and the inner wall, having a diameter smaller than the side wall, extending downwardly into the groove located on the upper end portion of a beverage can.

13 Claims, 1 Drawing Sheet

CAN CLEANING DEVICE

FIELD OF THE INVENTION

This invention relates to cleaning devices and, more particularly, to an improved cleaning device that cleans and sanitizes the upper portion of a metal or aluminum can or other similar article.

BACKGROUND OF THE INVENTION

Beverages and other food items are very frequently sold and stored in metal or aluminum cylindrical cans. These cans are frequently stored for what can be a lengthy period of time prior to sale. They are often transported for sale in locations far removed from their manufacturing or canning site, and they regularly sit on shelves, on loading docks, in machines and in other places prior to their actual sale to a consumer. During these periods of storage and transportation, the cans are susceptible to becoming dirty or contaminated, especially in and around the areas where, for example on a beverage can, a purchaser may place his or her mouth when consuming the contents of the can. In many instances, the liquid contents of the aluminum or metal cans accumulates in the ridges on the top of the cans and dries to a sticky, adhesive-type mass that is not easily removed. Not only may such dirt or other contaminants be transferred to consumers when their lips touch the can directly, but they may also be transferred when the contents of the can are poured or otherwise emptied into another container for consumption.

Simple wiping of the lids or upper portions of such cans does not always effectively clean these portions of the cans due to the irregular surfaces of beverage cans and the like. Beverage cans, for example, have a protruding element on the top that enables a purchaser to "pop" the top open for consumption of the contents. Further, the top of the can is commonly designed with a protruding rim and adjoining groove that makes cleaning with a simple cloth difficult. No device has previously been disclosed that allows a purchaser to effectively clean the upper portion of such cans with a device that both cleans and sanitizes the can portion, is disposable and, therefore, safe from a health standpoint, and is made from environmentally safe biodegradable, recyclable materials.

A number of simple structures directed to this general problem have previously been proposed. For example, U.S. Pat. No. 4,733,423 to Blatt discloses a pop top can brush that may be used to clean cans having a cleaning gutter and a plurality of outer and inner brushes depending downwardly from a planar arcuate upper member. U.S. Pat. No. 4,763,380 to Sandwick discloses a cleaning device formed from a circular disk having symmetrical openings and a plurality of bristles extending downwardly from the top surface of the device. To use the device, it is placed on the top of the can and water is allowed to run through the openings while the device is rotated back and forth with the bristles engaging the can. U.S. Pat. No. 4,813,091 to Glasener discloses a can cleaning device with a cylindrical base and a tapered side wall, all made of a plastic-like material, and having a cleaning material affixed to the inside face of the base and bristles concentrically arranged. Finally, U.S. Pat. No. 5,031,264 to Muster discloses a cleaning system that includes a pre-moistened pad that is sealed in a packet mounted to the underside of a self-opening can pull tab that, once exposed or completely removed, can be used to clean the can top. Other U.S. patents, such as U.S. Pat. Nos. 1,582,367; 4,912,801 and 5,014,869 disclose other rather different types of cleaning devices.

There are problems associated with each of these previously disclosed devices. For example, most of the devices are not disposable and, therefore, they cannot be conveniently and inexpensively dispensed to the consumers of the contents of the can at the point of purchase. Although Muster discloses a system that can be incorporated into the can for sale to the consumer, it lacks the capability to allow easy, thorough cleaning of the lip and groove or gutter of a beverage can. Furthermore, although the Muster device comprises a pre-moistened pad, neither it nor any other previously disclosed device provides a means for sanitizing the can top as a part of the wiping or cleaning process. It would be desirable, therefore, to provide an improved device that eliminates or at least substantially reduces these and other problems with previous devices. Accordingly, it is an object of the present invention to provide such an improved device.

SUMMARY OF THE INVENTION

Applicant's invention is related to a bristleless cleaning device for use in cleaning the upper portion of such aluminum or metal cans, including the ridges and indentations around the tops of cans. Applicant's device is designed to be disposable, recyclable, and hand-held. It is a circular, one-piece construction, operated by simple manual placement on and rotating over the top of the upper portion of the can. Alternatively, the device may be rotated using either a knob placed on top of the cleaning device or by placing finger tips on each of two raised finger pads placed opposite one another on the upper surface of the top of the cleaning device and twisting it over the top of the can. This has the added advantage of allowing the person operating the cleaning device to place pressure directly on the top of the can so that all areas across the top of the can can be fully cleaned.

Applicant's device has numerous advantages over the disclosed systems. Its one-piece construction affords a manufacturing cost savings. Its construction from an absorbent and deflectable yet sturdy material enhances its ability to clean and sanitize the can, even in ordinarily difficult-to-reach areas. Applicant's single piece device is easy to manufacture and easy to use. Its disposability is a major advantage that is enhanced by its being made of biodegradable or recyclable material, an element of great concern and appeal to today's consumers.

BRIEF DESCRIPTION OF THE DRAWINGS

For an understanding of the present invention and for further objects and advantages thereof, reference may now be had to the following description, taken in conjunction with the accompanying drawings, in which.

DETAILED DESCRIPTION

Figure 1:
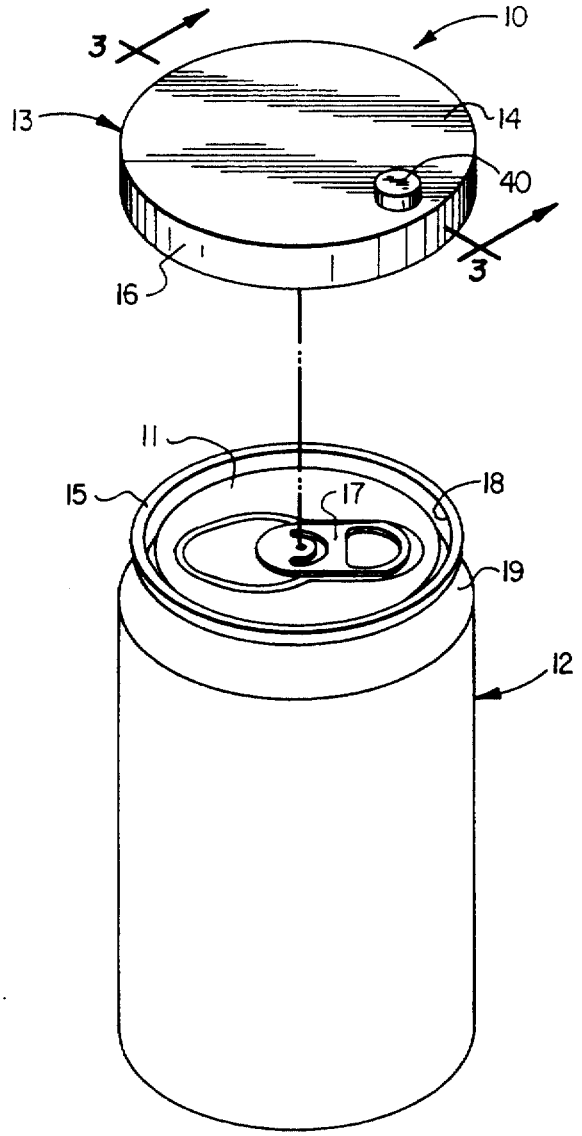
FIG. 1 is an exploded perspective view of a typical beverage can and a can cleaning device embodying principles of the present invention.
Figure 3:
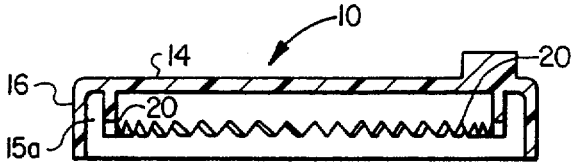
FIG. 3 is an enlarged scale cross-sectional view through the cleaning device taken along line 3—3 of FIG. 1.
Figure 2:
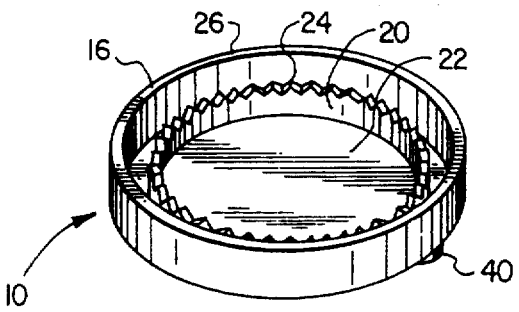
FIG. 2 is a bottom side perspective view of the can cleaning device.

Referring first to FIG. 1, a new and improved can cleaning device 10 embodying principles and concepts of the present invention will be described. The can cleaning device 10 is made to fit snugly over the top of a can 12 and includes a body 13 comprising a circular base wall 14 from the periphery of which a circular side wall 16 transversely depends. As illustrated in FIG. 2, the cleaning device 10 has a smaller diameter circular inner side wall 20 also depending from the base wall 14, inwardly of the side wall 16 such that the inner wall 20 fits into the groove 18 on the top portion of the can 12, as shown in FIG. 1. The circular side walls 16, 20 define therebetween an annular cavity 15*a* (see FIG. 3) for complementarily receiving the lip 15 of a can 12. The base wall and side walls each have an inner and outer side surface, and the side walls each have a bottom edge.

The outer side wall 16 has a width sufficient to fit well down over the upper portion of the can 12 and past the indentation 19 that is typically present at the upper portion of a beverage can 12, as illustrated in the embodiment shown in FIG. 1. The inner wall 20, however, has a width sufficient to reach to the bottom of the groove 18 on the top of the can 12 and is, therefore, slightly shorter than the side wall 16. This shorter width of the inner wall 20 ensures that the groove 18 and the inner portion of the lip 15 of the can 12 are fully cleaned. When the cleaning device 10 is placed on the top of the can 12, the outer wall fits snugly around the can, covering the indentation 19; the inner wall 20 fits securely down into the groove, with the base 14 of the cleaning device 10 resting on the top of the can and the pop top 17. The lip of the can 15 is received between the side wall 16 and the inner wall 20.

The cleaning device 10 has the advantage of being die stamped or otherwise integrally formed as a single piece. It has the further advantage of being made of either a sturdy yet flexible, fibrous paper/cloth-like material akin to a rigid terry cloth or a rigid, expanded foam type material that is both absorbent, to receive a sanitizing solution, and deflectable, to better fit and thereby clean the can 12. Being absorbent, the entire cleaning device 10 can be and is, in its preferred embodiment, treated with a sanitizing or disinfecting solution in order to provide enhanced cleaning capability. The sanitizing solution may, representatively, consist of any largely odorless, tasteless sanitizer or may consist, for example, of a mixture of benazon acid, alcohol and water or other similar compound. The lower edges of the inner wall 20 and the outer side wall 16 may either both be smooth and continuous as illustrated in the alternate can cleaning device embodiment 10*a* shown in FIG. 5, or the inner wall 20 may be rough or serrated 24 while the outer wall 16 is continuous and smooth 26 on its lower edge as illustrated in FIG. 2. In a preferred embodiment, the lower edges are as illustrated in FIG. 2.

Figure 5:
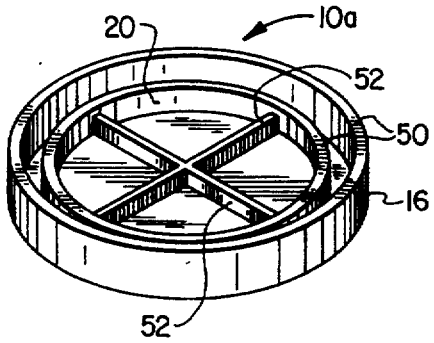
FIG. 5 is a bottom side perspective view of a second alternate embodiment of the can cleaning device.

In alternate can cleaning device embodiment 10*a* (FIG. 5), additional cross walls 52 may be added, depending downwardly from the bottom portion of the base 14 to add extra cleaning ability for cleaning the top portion of the can 12, as illustrated in FIG. 5. These cross walls 52 are operatively disposed perpendicularly to one another, with each end of each cross wall 52 having as its end point the inner side surface of the inner side wall 20. In this embodiment, the cross walls 52 have a width slightly less than the inner side wall 20. So that the inner wall can still fit fully into the groove 18 and so that the outer side wall 16 will continue to fit well over the lip 15 of the can 12 and over the indentation 19, the widths of the inner wall 20 and outer wall 16 may be extended slightly over the widths in the embodiment illustrated in FIG. 2.

Figure 4:
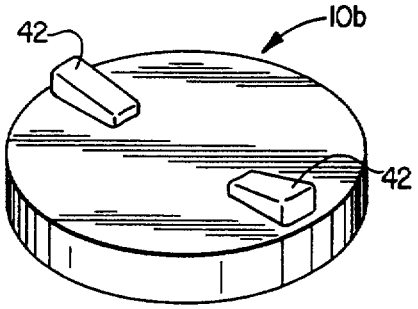
FIG. 4 is a top side perspective view of a first alternate embodiment of the can cleaning device.

In use, the cleaning device is manually applied to the upper end portion of the can to be cleaned. It is then manually rotated over the upper end portion of the can 12 to effect the cleaning of the top 11, upper sides and indentation 19, lip 15, and groove 18 of the can 12. In this embodiment (not pictured), there is no knob 40 (as shown in FIG. 1 and FIG. 2) or other raised finger pad surfaces 42 (such as those shown in alternate can cleaning device embodiment 10*b* in FIG. 4) to assist in the turning or rotating of the cleaning device 10 over the top portion of the can 12. As can readily be appreciated, a number of items such as the knob 40, pictured in FIG. 1, or the slightly raised finger pads 42 made from a sturdy, somewhat less pliable material than the rest of the cleaning device 10 such as a plastic or stiffer cardboard-like material and preferably made with indentations or curved to fit the shape of a finger, may be placed on the outer side surface of the base wall 14 to assist in the rotation of the can 12 or the can cleaning device 10.

The can cleaning device 10 of the present invention, because of its size, its material components, its low cost and its disposability, can easily be sold or provided to consumers of canned products, in particular, beverages, in a variety of ways. It is possible for the cleaning device 10 to be dispensed from a beverage machine. Similarly, the cleaning devices 10 could be dispensed from a separate vending machine that might be located nearby to beverage machines or in office or other public snack or vending areas. Because of their small size and the fact that they may be individually packaged in cellophane or other such material, the present can cleaning devices 10 could also be sold over the counter in grocery stores, delis, smaller convenience stores or in any other location where cans are sold or otherwise provided for consumption. The ready availability of the present cleaning device, which is disposable and environmentally safe, will be of great use to consumers who do not wish to ingest food or beverage from cans that are dirty or contaminated. With the present device 10, consumers will be able to clean and sanitize such cans without the need to carry a large device with them or to have a cloth and cleaning solution with them, or to be forced to use their own clothing to clean cans before consuming their contents.

It is thus believed that the operation and construction of the present invention will be readily apparent from the foregoing discussion. While the method, apparatus and system shown and described has been characterized as being preferred, it should be readily apparent that various changes and modifications may be made therein without departing from the spirit and scope of the invention as defined by the following claims.

What is claimed is:

1. For use in manually cleaning an end portion of a can, the can end portion having a circular end wall with an outer side surface and an axially indented annular peripheral portion joined to the inner side of an annular lip that axially extends outwardly past the end wall outer side surface and forms with the indented peripheral end wall portion an annular end groove in the can, a can cleaning device comprising:

a body formed from a resilient, absorbent material and having:

a base wall having an inner side surface and an outer side surface; and annular, concentric first and second walls formed on and axially projecting from said base wall inner side surface and each having an inner side surface, an outer side surface and a bottom edge, said bottom edge of said second wall being non-planar and said second wall being of a smaller diameter than said first wall and forming therewith an annular recess configured to complementarily receive the can lip in a manner permitting said body to be manually rotated relative to the can end portion to cause an axially outer portion of said second wall to wipe and clean the indented annular peripheral portion of the can end wall, and the interior surface of said recess to wipe and clean the can lip complementarily received therein.

2. The apparatus of claim 1 wherein said resilient, absorbent material is treated with a sanitizing solution.

3. The apparatus of claim 1 further comprising:

at least two cross walls integrally formed on and axially projecting from the base wall inner side surface and having end-points on the inner side surface of said second wall.

4. The apparatus of claim 3 wherein said cross walls are made from a resilient, absorbent material.

5. The apparatus of claims 4 wherein said absorbent material is treated with a sanitizing solution.

6. The apparatus of claim 1 further comprising:

means for rotating said apparatus over the end portion of said can.

7. The apparatus of claim 6 wherein said means for rotating comprises a knob, operatively disposed on the outer side surface of said base wall.

8. The apparatus of claim 6 in which said means for rotating comprises a pair of raised finger pad surfaces, operatively disposed on the outer side surface of said base wall, each finger pad being located near the periphery of said base wall, and the first finger pad being diametrically opposed to the second finger pad.

9. A disposable, one-piece apparatus made from an absorbent material treated with a sanitizing solution for use in cleaning an upper end portion of a can, comprising:

a base wall having an inner side surface and an outer side surface, sized to fit snugly over the upper end portion of a can; and annular, concentric first and second cleaning means, each having a bottom edge and each depending from the inner side surface of said base wall, said bottom edge of said second cleaning means being non-planar, said first cleaning means being integrally formed along the peripheral portion of said base wall and said second cleaning means being integrally formed on the inner side surface of said base wall and having a diameter smaller than said first cleaning means, such that said first and second cleaning means form a cavity for receiving the lip of a can.

10. The apparatus of claim 9 wherein said first and second cleaning means have a width and said width of said second cleaning means is less than said width of said first cleaning means such that said second cleaning means rests on the bottom of a groove on the upper end portion of a can.

11. The apparatus of claim 9 further comprising:

means for rotating said apparatus over the upper end portion of the can.

12. The apparatus of claim 11 wherein said rotating means comprises a knob, operatively disposed on the outer side surface of said base wall.

13. The apparatus of claim 11 wherein said rotating means comprises a pair of finger pad surfaces, operatively disposed on the outer side surface of said base wall, each finger pad being near the peripheral portion of said base and the first finger pad being diametrically opposed to the second finger pad.

* * * * *